US008205876B2

(12) United States Patent
Shingai

(10) Patent No.: US 8,205,876 B2
(45) Date of Patent: Jun. 26, 2012

(54) SHEET EJECTOR AND SHEET FEEDER HAVING THE SAME FOR INSERTING LATER-EJECTED SHEETS UNDER EARLIER-EJECTED SHEETS

(75) Inventor: Hiroyuki Shingai, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/727,767

(22) Filed: Mar. 19, 2010

(65) Prior Publication Data

US 2010/0301544 A1 Dec. 2, 2010

(30) Foreign Application Priority Data

May 28, 2009 (JP) ..... 2009-129362

(51) Int. Cl.
*B65H 31/08* (2006.01)

(52) U.S. Cl. ..... 271/212; 271/213; 271/218

(58) Field of Classification Search ..... 271/185, 271/186, 163, 212, 213, 218; 399/374
See application file for complete search history.

(56) References Cited

U.S. PATENT DOCUMENTS 5,078,383 A * 1/1992 Shiina et al. ..... 271/212
6,095,517 A * 8/2000 Dinatale ..... 271/212
7,762,543 B2 * 7/2010 Matsushima ..... 271/3.14
2007/0081212 A1 * 4/2007 Tonami et al. ..... 359/197
2007/0210512 A1 9/2007 Sakakibara et al.
2009/0324312 A1 * 12/2009 Kusama ..... 399/405

FOREIGN PATENT DOCUMENTS

JP SHO63-26661 2/1988
JP 4106064 A 4/1992
JP 08-282897 10/1996
JP 08282897 A * 10/1996
JP 2000118822 A 4/2000
JP 2007-238252 9/2007
JP 2008024430 A 2/2008

OTHER PUBLICATIONS

Notifications of Reasons for Rejection for application No. 2009-129362 mailed Apr. 19, 2011.
Notification of Reasons for Rejection for Japanese patent application No. 2009-129362 mailed Jan. 10, 2012.

* cited by examiner

*Primary Examiner* — Gerald McClain
(74) *Attorney, Agent, or Firm* — Banner & Witcoff, Ltd.

(57) ABSTRACT

A sheet ejector, configured to eject sheets so as to insert a later-ejected sheet under an earlier-ejected sheet on a catch tray, includes a feed roller provided to the catch tray, wherein the feed roller is configured to feed, in a predetermined ejecting direction, the later-ejected sheet that is inserted under the earlier-ejected sheet, and a switching mechanism configured to switch a state of the feed roller relative to a sheet on the catch tray between a contact state where the feed roller contacts the sheet on the catch tray and a non-contact state where the feed roller is kept from contacting the sheet on the catch tray.

18 Claims, 6 Drawing Sheets

SHEET EJECTOR AND SHEET FEEDER HAVING THE SAME FOR INSERTING LATER-EJECTED SHEETS UNDER EARLIER-EJECTED SHEETS

CROSS-REFERENCE TO RELATED APPLICATION

This application claims priority under 35 U.S.C. §119 from Japanese Patent Application No. 2009-129362 filed on May 28, 2009. The entire subject matter of the application is incorporated herein by reference.

BACKGROUND

1. Technical Field

The following description relates to one or more techniques for a sheet ejector to eject sheets onto a catch tray.

2. Related Art

In general, as an example of a sheet ejector configured to eject a sheet (e.g., a document sheet and a sheet with an image formed thereon) onto a catch tray, a sheet ejector has been known that ejects a sheet in an insertion mode so as to insert the sheet under a stack of sheets that have already been ejected on a catch tray.

SUMMARY

In the meantime, the aforementioned sheet ejector has a problem that as the number of the sheets stacked on the catch tray increases, it might be harder to insert a later-ejected sheet under a stack of earlier-ejected sheets on the catch tray due to an increased frictional resistance between the later-ejected sheet and a bottom one of the earlier-ejected sheets. It might lead to a wrinkled sheet or a paper jam.

In particular, when heavy sheets or sheets with a high degree of surface roughness are ejected, the frictional resistance between the sheets tends to rise. Consequently, it might be harder in an earlier stage to insert a later-ejected sheet under a stack of earlier-ejected sheets on the catch tray. Thus, it might be more likely to lead to a wrinkled sheet and a reduced number of sheets permitted to be ejected onto the catch tray.

The above problems are unique to a sheet ejector configured to eject sheets in the insertion mode, but do not matter to a sheet ejector configured to eject sheets in a stacking mode to sequentially stack a later-ejected sheet onto earlier-ejected sheets on a catch tray.

Aspects of the present invention are advantageous to provide one or more improved techniques that make it possible to eject sheets in the insertion mode in a preferable manner depending on situations.

According to aspects of the present invention, a sheet ejector is provided that is configured to eject sheets so as to insert a later-ejected sheet under an earlier-ejected sheet on a catch tray. The sheet ejector includes a feed roller provided to the catch tray, wherein the feed roller is configured to feed, in a predetermined ejecting direction, the later-ejected sheet that is inserted under the earlier-ejected sheet, and a switching mechanism configured to switch a state of the feed roller relative to a sheet on the catch tray between a contact state where the feed roller contacts the sheet on the catch tray and a non-contact state where the feed roller is kept from contacting the sheet on the catch tray.

According to aspects of the present invention, further provided is a sheet feeder, which includes a sheet ejector configured to eject sheets so as to insert a later-ejected sheet under an earlier-ejected sheet on a catch tray. The sheet ejector includes a feed roller provided to the catch tray, wherein the feed roller is configured to feed, in a predetermined ejecting direction, the later-ejected sheet that is inserted under the earlier-ejected sheet, and a switching mechanism configured to switch a state of the feed roller relative to a sheet on the catch tray between a contact state where the feed roller contacts the sheet on the catch tray; and a non-contact state where the feed roller is kept from contacting the sheet on the catch tray.

BRIEF DESCRIPTION OF THE ACCOMPANYING DRAWINGS

Figure 4A:
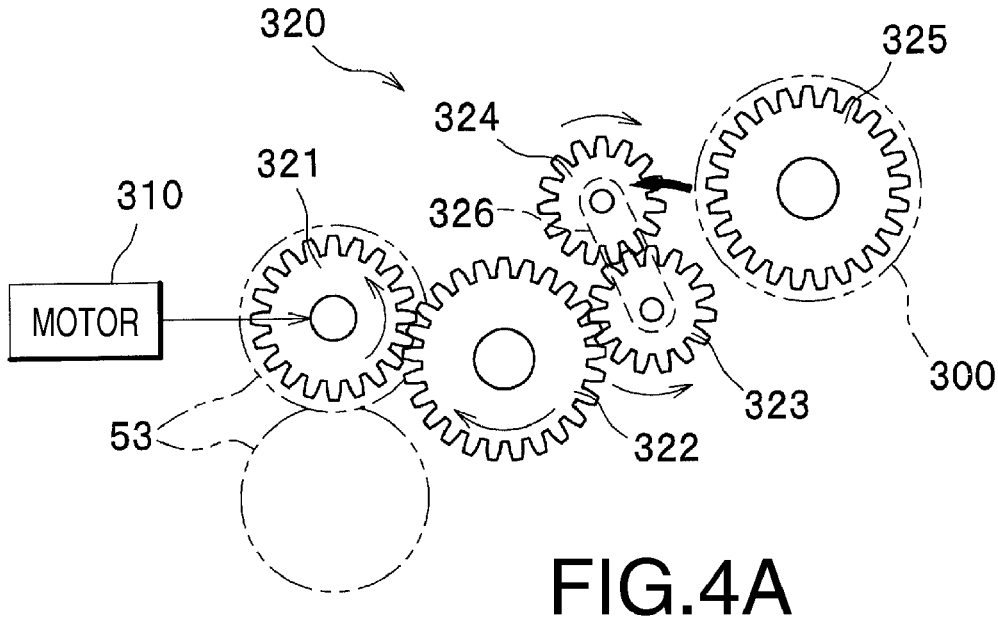

FIG. 4A schematically shows a configuration of a driving mechanism for an assist feed roller with a planet gear located away from a transmission gear in the embodiment according to one or more aspects of the present invention.

Figure 4B:
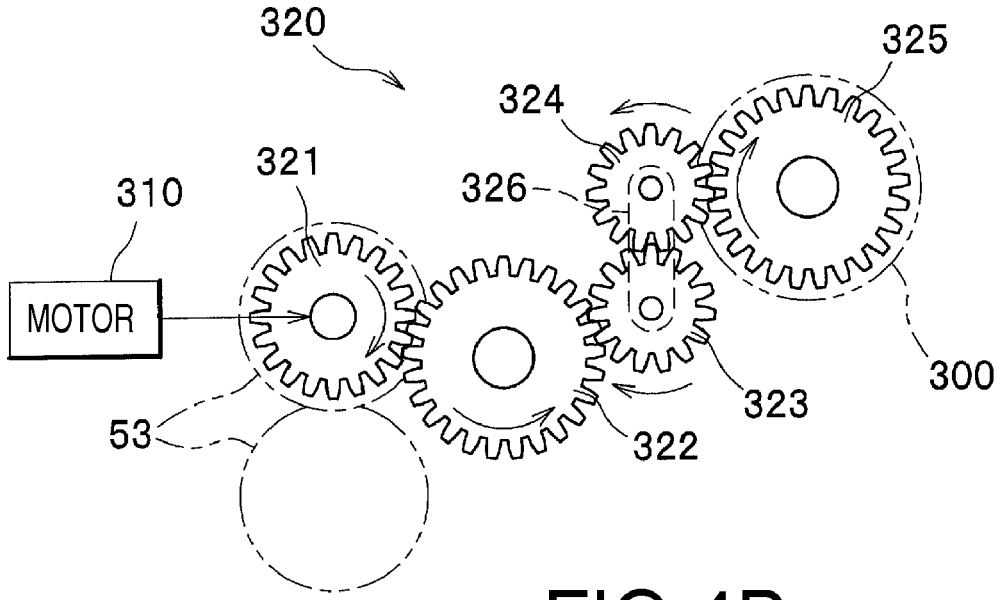

FIG. 4B schematically shows a configuration of the driving mechanism for the assist feed roller with the planet gear engaged with the transmission gear in the embodiment according to one or more aspects of the present invention.

Figure 5A:
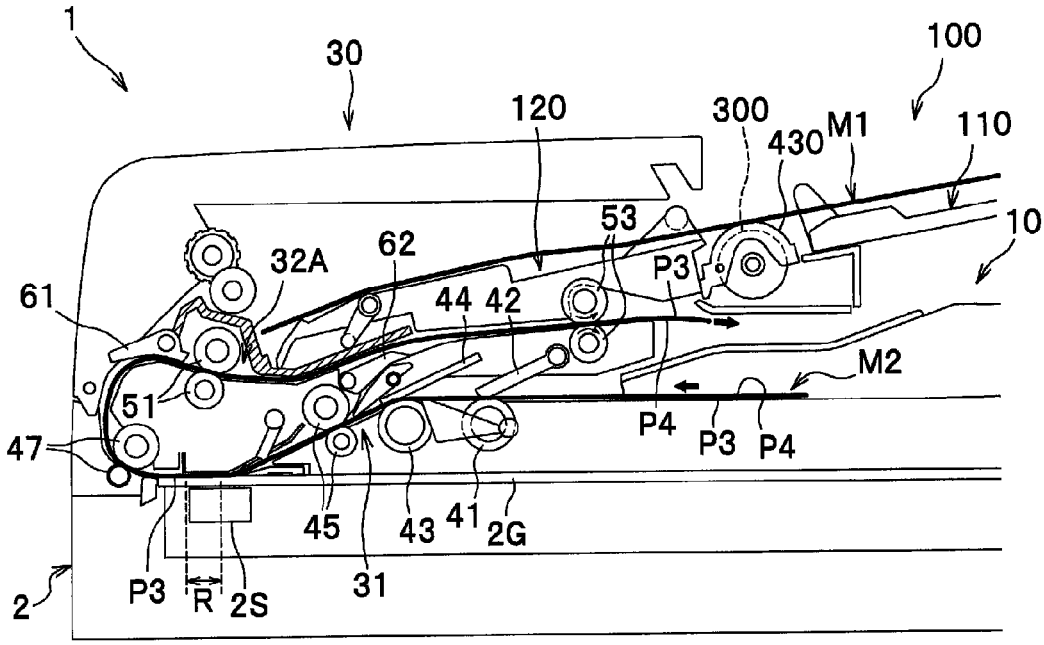
Figure 5B:
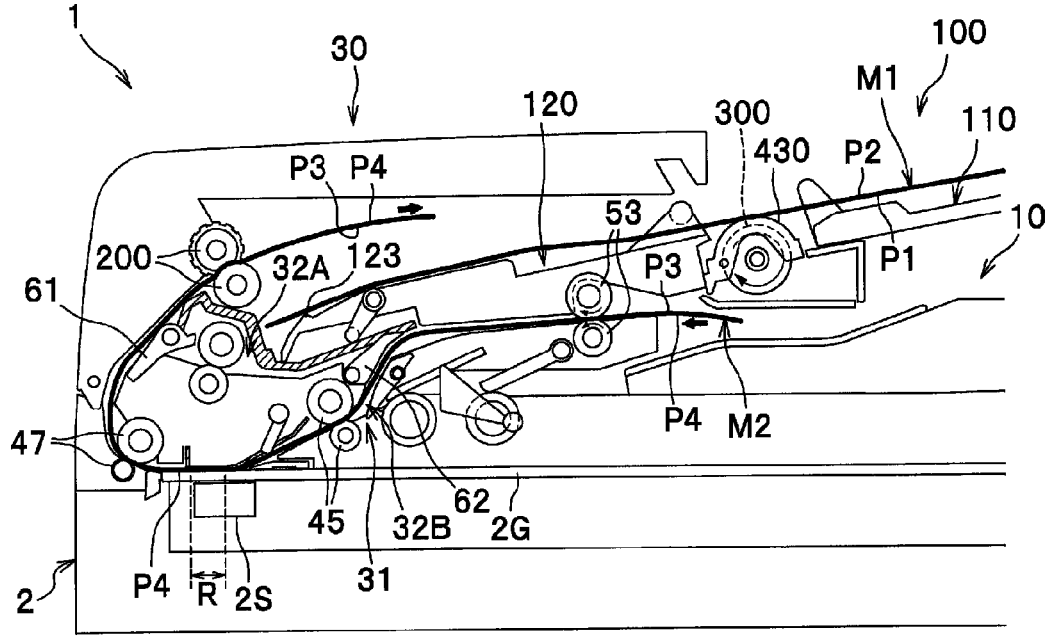

FIGS. 5A and 5B illustrate an operation of the document feeder in a stacking mode in the embodiment according to one or more aspects of the present invention.

Figure 6:
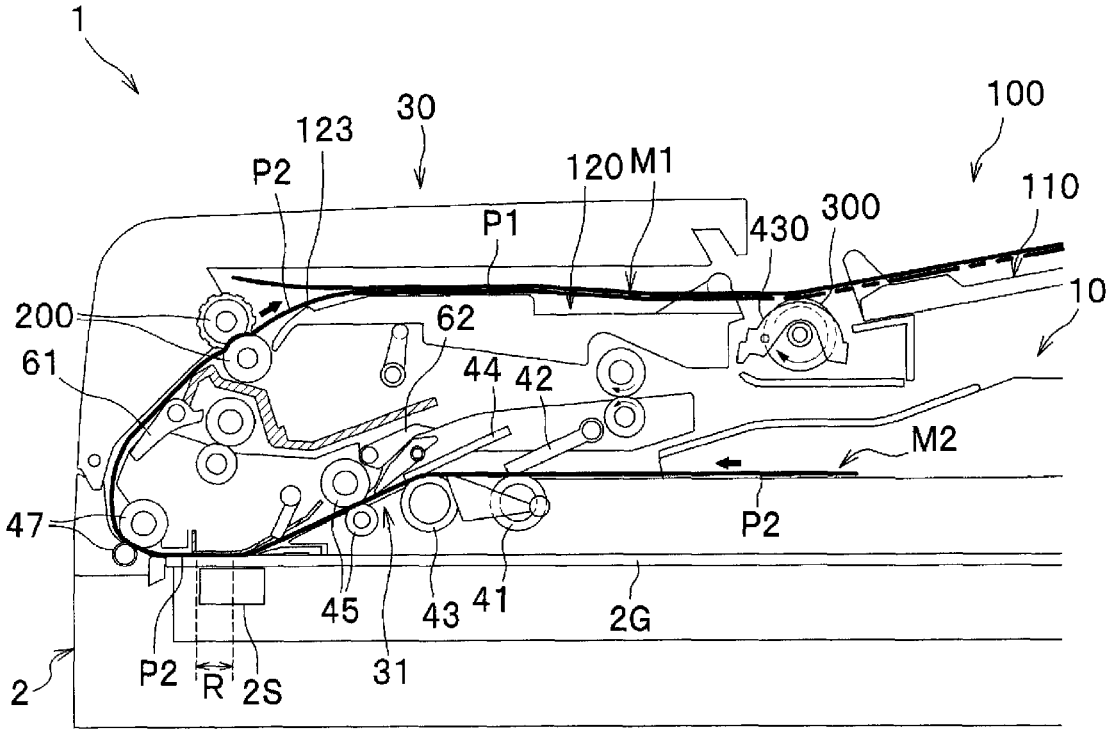

FIG. 6 illustrates an operation of the document feeder in an insertion mode in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings. In the following description, an explanation about a general configuration of a document feeder 1 having a sheet ejector in the embodiment will first be provided and followed by an explanation about a detailed configuration of the sheet ejector.

Further, in the following description, a "feeding direction" represents a direction (see a thick solid line in FIG. 2) in which a document sheet is fed from a feed tray 10 to a catch tray 100. In addition, an "ejecting direction" represents a direction in which a document sheet is ejected from a document feeding unit 30 (ejection rollers 200) to the catch tray 100. Moreover, upstream and downstream in each of the feeding direction and the ejecting direction will simply be referred to as "upstream" and "downstream." Furthermore, a direction (a width direction of a document sheet) perpendicular to the feeding direction and the ejecting direction will be referred to as a "width direction."

<General Configuration of Document Feeder>

Figure 1:
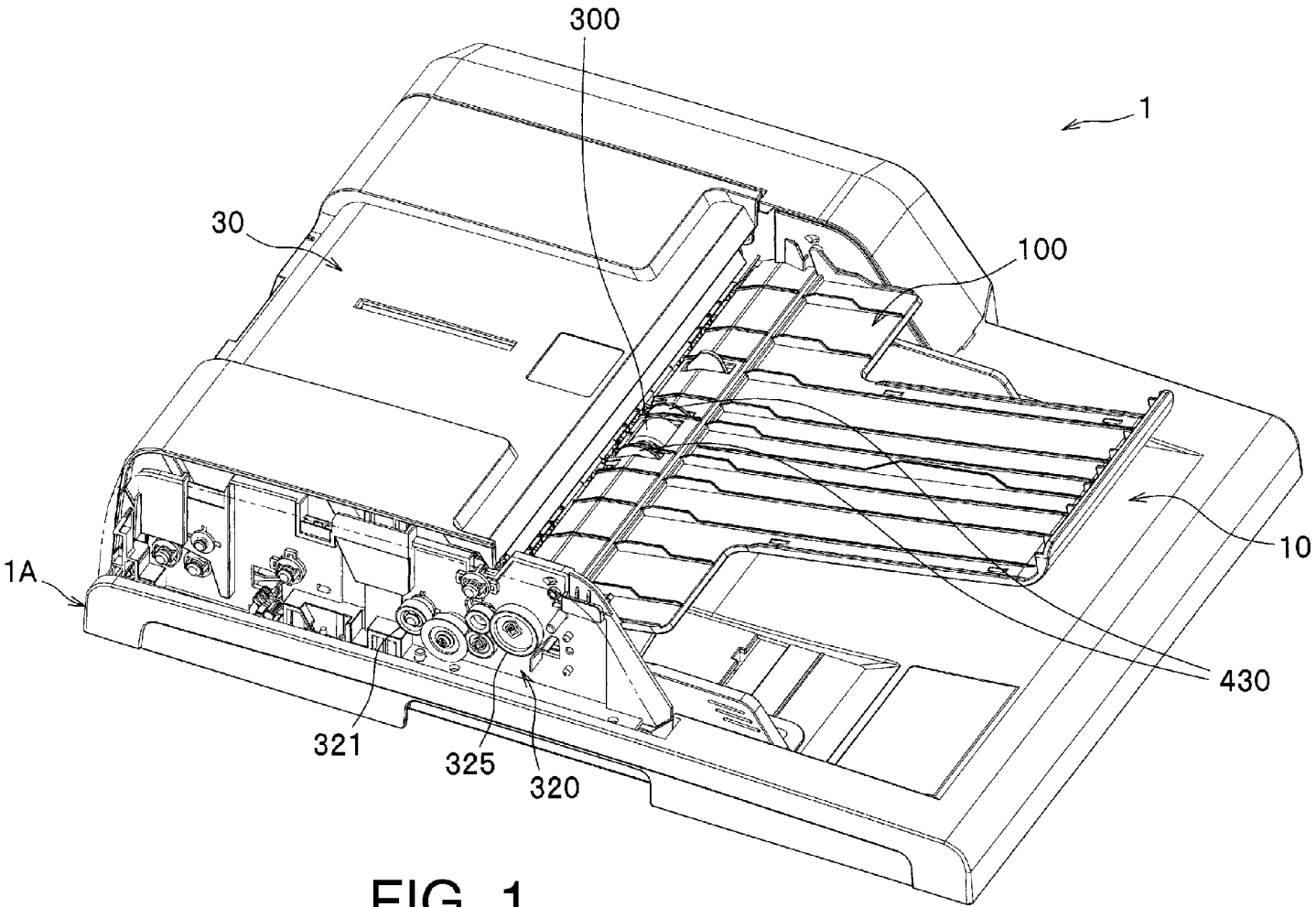
FIG. 1 is a perspective view showing an external configuration of a document feeder having a sheet ejector in an embodiment according to one or more aspects of the present invention.

As shown in FIG. 1, a document feeder 1 includes a feed tray 10 configured to support document sheets stacked thereon, a catch tray 100 configured to receive document sheets ejected thereon, and a document feeding unit 30 configured to feed document sheets from the feed tray 10 to the catch tray 100.

Figure 2:
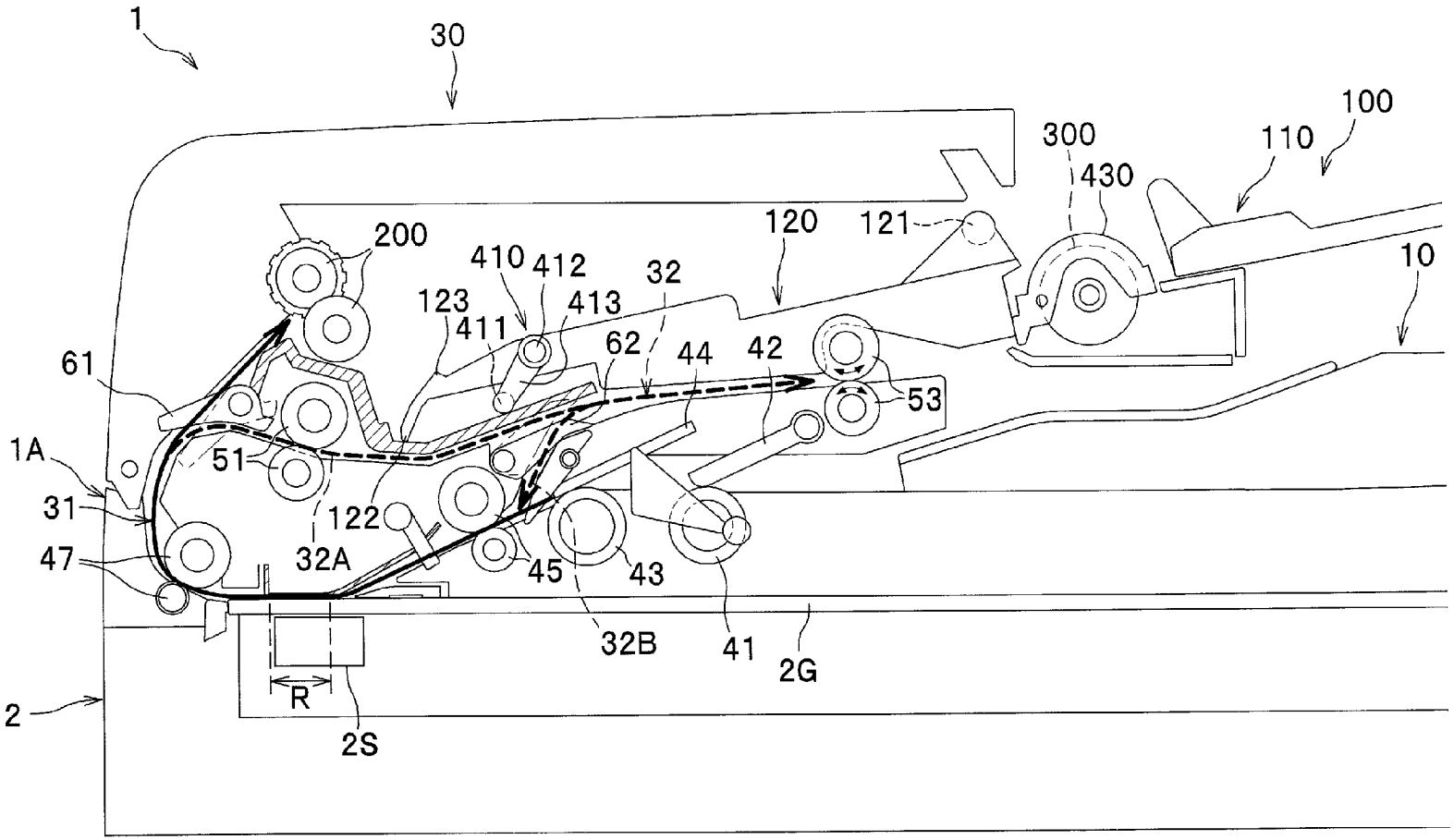
FIG. 2 is a side view showing an internal configuration of the document feeder in the embodiment according to one or more aspects of the present invention.

As illustrated in FIG. 2, there is a known flatbed scanner 2 disposed beneath the document feeder 1. The document feeder 1 is configured to be opened and closed relative to the flatbed scanner 2.

The flatbed scanner 2 includes a platen glass 2G on which a document sheet is statically placed when the document feeder 1 is opened, and an image sensor 2S. The flatbed scanner 2 is configured to read an image on a document sheet that is statically placed on the platen glass 2G while scanning the document sheet with the image sensor 2S, and to read an image on a document sheet that is conveyed in a reading position R by the document feeder 1.

The document feeding unit 30 is formed with a substantially U-shaped feeding path 31 (see a thick solid line in FIG. 2) configured to guide a document sheet from the feed tray 10 to the catch tray 100, and a substantially Y-shaped reverse path 32 (see a thick dashed line) configured to switch back a document sheet.

On the feeding path 31, a pickup roller 41, a pickup arm 42, a separation roller 43, a separation arm 44, first feed rollers 45, second feed rollers 47, and ejection rollers 200 are disposed sequentially from an upstream side to a downstream side. Between the first feed rollers 45 and the second feed rollers 47, there is a reading position R that faces the image sensor 2S across the platen glass 2G. The reverse path 32 diverges from the feeding path 31 downstream relative to the second feed rollers 47. In a diverging point between the feeding path 31 and the reverse path, there is a flap-shaped first guide member 61 configured to swing up and down so as to sort a document sheet into one of the feeding path 31 and the reverse path 32.

The reverse path 32 includes a first path 32A that extends from the diverging point toward the outside (rightward in FIG. 2), and a second path 32B that diverges from the first path 32A and joins the feeding path 31 (upstream relative to the first feed rollers 45). On the first path 32A, third feed rollers 51 and switchback rollers 53 are disposed.

The switchback rollers 53 are known rollers for reversing (switching back) a document sheet upside down, each of which is rotated in any of a forward direction for ejecting the document sheet out of the reverse path 32 and a backward direction for pulling back the document sheet. Specifically, under a known control technique, the switchback rollers 53 is rotated in the forward direction so as to partially eject the document sheet outward until a tail end of the document sheet completely passes through a diverging point between the first path 32A and the second path 32B. Then, after a temporary stop, the switchback rollers 53 are rotated in the backward direction so as to pull back and feed the document sheet to the second path 32B.

Switching between the first path 32A and the second path 32B is carried out by a flap-shaped second guide member 62, which is disposed in the diverging point between the first path 32A and the second path 32B and configured to swing up and down.

<Detailed Configuration of Sheet Ejector>

A sheet ejector of the embodiment includes the catch tray 100, the ejection rollers 200 configured to eject a document sheet fed on the feeding path 31 onto the catch tray 100, an assist feed roller 300, and a switching mechanism (as will be described below, which includes a flap 120, a cam 410, and roller guards 430). As will be explained in detail below, the sheet ejector is configured to eject a document sheet so as to insert the document sheet under a stack of document sheets that have already been ejected on the catch tray 100.

[Configuration of Catch Tray]

The catch tray 100 is disposed above the feed tray 10 and provided with a fixed tray 110 and a flap 120 placed upstream relative to the fixed tray 110. The fixed tray 110 is fixed to a main body frame 1A constituting an outer frame so as not to be displaced relative to the document feeding unit 30.

The flap 120 is supported by the main body frame 1A such that an upstream end 122 thereof is swingable around a swing shaft 121 (a swing center) provided at a downstream side. An upstream side of the flap 120 is bent downward, and the bending portion of the flap 120 is formed with a protruding section 123 that protrudes upward.

The flap 120 is swung up and down by a cam 410 provided to the main body frame 1A. The cam 410 is disposed at an upstream side of the flap 120. The cam 410 has a push-up bar 411 that is provided at a lower side of the cam 410 and configured to extend in the width direction, a pair of shaft portions 412 supported by the main body frame 1A rotatably in forward and backward directions, and a pair of joints 413 that connect both ends of the push-up bar 411 and the shaft portions 412, respectively.

Figure 3A:
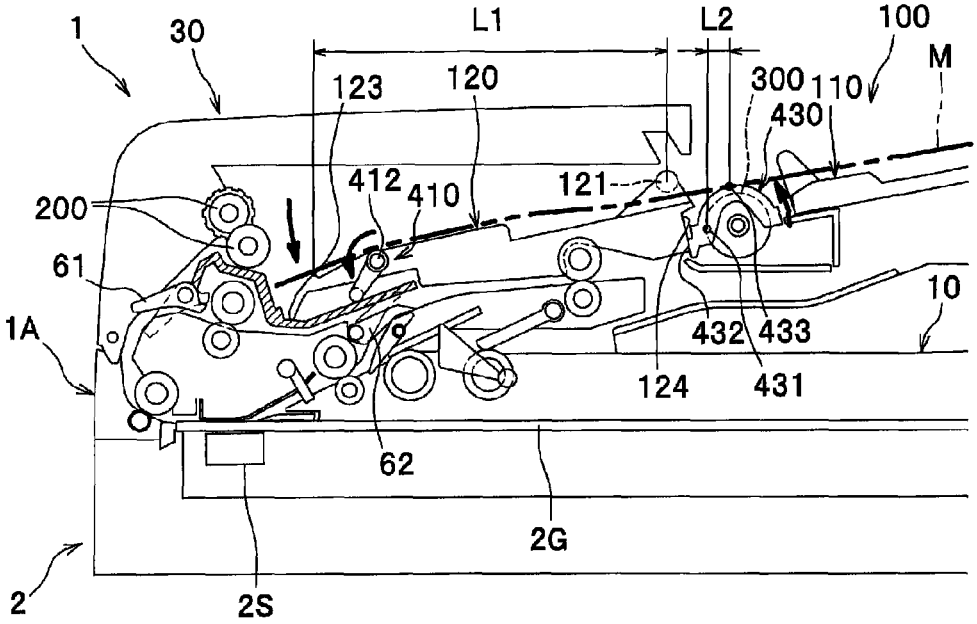
FIG. 3A is a side view showing the document feeder with a flap set in a lower position in the embodiment according to one or more aspects of the present invention.
Figure 3B:
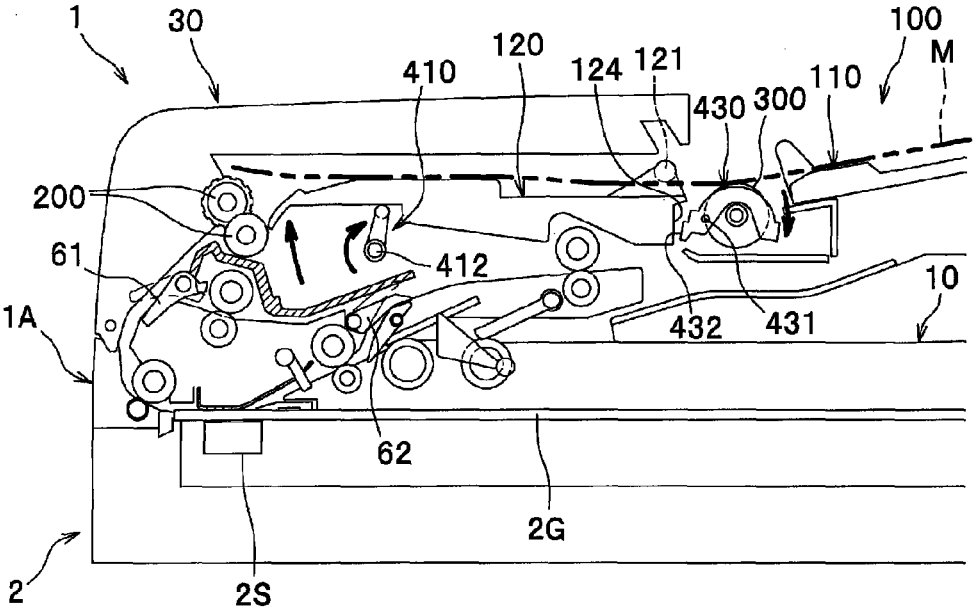
FIG. 3B is a side view showing the document feeder with the flap set in an upper position in the embodiment according to one or more aspects of the present invention.

When the shaft portions 412 are rotated, the cam 410 causes the flap 120 to swing between a lower position shown in FIG. 3A and an upper position shown in FIG. 3B. Thereby, it is possible to switch an ejection mode for the document feeder 1 to eject a document sheet between a stacking mode (see FIG. 5B) where the ejected document sheet is stacked on document sheets earlier ejected on the catch tray 100 and an insertion mode (see FIG. 6) where the ejected document sheet is inserted under a stack of document sheets earlier ejected on the catch tray 100. Operations in the stacking mode and the insertion mode will be set forth below.

As illustrated in FIG. 3B, the catch tray 100 is set, in the insertion mode, such that an upper surface of the flap 120 extends substantially in a horizontal direction, and that an upper surface of the fixed tray 110 disposed downstream relative to the flap 120 extends obliquely upward toward a downstream side. Meanwhile, as illustrated in FIG. 3A, the catch tray 100 is set, in the stacking mode, such that the upper surface of the flap 120 and the upper surface of the fixed tray 110 form an integrated oblique surface which extends obliquely upward toward the downstream side.

[Configuration of Assist Feed Roller]

As illustrated in FIG. 2, the assist feed roller 300 is provided at an upstream end of the fixed tray 110 of the catch tray 100, such that a part (an upper portion) thereof protrudes from the upper surface of the catch tray 100 (the fixed tray 110).

The assist feed roller 300 feeds a later-ejected document sheet, which is inserted under earlier-ejected document sheets, in the ejecting direction when driven to rotate clockwise in FIG. 6. More specifically, the assist feed roller 300 is a roller configured to feed the later-ejected document sheet in the ejecting direction in an auxiliary manner. In other words, the assist feed roller 300 assists the later-ejected document sheet fed by the ejection rollers 200 to insert under the earlier-ejected document sheets.

The assist feed roller 300 has a roller surface configured to apply, to document sheets that have already been ejected on the catch tray 100, such a frictional resistance as not to feed (move) the already-ejected document sheets only by the rotation of the assist feed roller 300. Thereby, it is possible to prevent the document sheets that have already been ejected on the catch tray 100 from falling out of the catch tray 100.

Further, when driven, the assist feed roller 300 rotates at a circumferential velocity equal to or less than an ejection velocity (a circumferential velocity of the ejection rollers 200) at which the ejection rollers 200 ejects a document sheet. Thereby, since a feeding velocity at which the assist feed roller 300 feeds a document sheet is equal to or less than the ejection velocity at which the ejection rollers 200 ejects a document sheet, it is possible to prevent the earlier-ejected document sheets from falling out of the catch tray 100.

To provide a supplemental explanation, when a later-ejected document sheet is inserted under an earlier-ejected document sheet, the earlier-ejected document sheet is likely to move due to a friction between the earlier-ejected document sheet and the later-ejected document sheet. Therefore, if the feeding velocity of the assist feed roller 300 is higher than the ejection velocity of the ejection roller 200, the earlier-ejected document sheet might move and fall out of the catch tray 100. Thus, in the embodiment, as the feeding velocity of the assist feed roller 300 is equal to or lower than the ejection velocity of the ejection rollers 200, it is possible to prevent the earlier-ejected document sheet from falling out of the catch tray 100.

Subsequently, an explanation will be provided about a configuration of a driving mechanism for the assist feed roller 300. As illustrated in FIGS. 4A and 4B, the assist feed roller 300 is driven to rotate in conjunction with the switchback roller 53. Specifically, the driving mechanism of the assist feed roller 300 includes a motor 310 and a gear unit 320.

The motor 310 is a known motor that is disposed in an appropriate position within the main body frame 1 and rotatable in both rotational directions. The motor 310 transmits a driving force to the pickup roller 41, the separation roller 43, the first feed rollers 45, the second feed rollers 47, the ejection rollers 200, the third feed rollers 51, the switchback rollers 53, and the assist feed rollers 300.

The gear unit 320 is disposed on a side of the assist feed roller 300 in the width direction (see FIG. 1) within the main body frame 1A. The gear unit 320 is configured to transmit the driving force of the motor 310 to the switchback rollers 53 and the assist feed roller 300. The gear unit 320 includes a switchback roller gear 321, an intermediate gear 322, a sun gear 323, a planet gear 324, and a transmission gear 325.

The switchback gear 321 is configured to rotate integrally with an upper roller of the switchback rollers 53 and transmit to the switchback rollers 53 the driving force which is provided by the motor 321 directly or indirectly via one or more other gears. The intermediate gear 322 is engaged with the switchback roller gear 321 and the sun gear 323 so as to transmit the driving force from the switchback roller gear 321 to the sun gear 323.

The sun gear 323 and the planet gear 324 are engaged with each other in a state where rotational shafts of the sun gear 323 and the planet gear 324 are inserted into holes provided to the joint 326, respectively. The sun gear 323 and the planet gear 324, joined with each other, are configured such that the planet gear 324 is swingable around the rotational shaft (a rotation center) of the sun gear 323 between a position where the planet gear 324 is engaged with the transmission gear 325 and a position where the planet gear 324 is away from the transmission gear 325.

The transmission gear 325 is configured to rotate integrally with the assist feed roller 300 and transmit to the assist feed roller 300 the driving force which is transmitted by the planet gear 324.

In the driving mechanism configured as above, as shown in FIG. 4B, when the motor 310 rotates in a predetermined direction so as to rotate (the upper one of) the switchback rollers 53 (the switchback roller gear 321) in the backward direction for pulling back a document sheet, the sun gear 323 rotates clockwise in FIG. 4B. Thereby, the planet gear 324 is engaged with the transmission gear 325 to transmit the driving force to the transmission gear 325. Thus, the assist feed roller 300 is driven to rotate.

Meanwhile, as illustrated in FIG. 4A, when the motor 310 rotates in another direction opposite to the above predetermined direction so as to rotate each (or the upper one) of the switchback rollers 53 (the switchback roller gear 321) in the forward direction for ejecting a document sheet, the sun gear 323 rotates counterclockwise in FIG. 4A. Thereby, the planet gear 324 is away from the transmission gear 325. Thus, since the driving force is not transmitted to the transmission gear 325, the assist feed roller 300 stops.

[Configuration of Switching Mechanism]

As shown in FIGS. 3A and 3B, the switching mechanism of the embodiment includes the flap 120, the cam 410 for swinging the flap 120, and a pair of roller guards 430.

As will be described in detail below, the switching mechanism is configured to switch a state of the assist feed roller 300 relative to a document sheet M on the catch tray 100 between a contact state where the assist feed roller 300 contacts the document sheet M (see FIG. 3B) and a non-contact state where the assist feed roller 300 does not contact the document sheet M (see FIG. 3A). More specifically, the switching mechanism is configured to operate in conjunction with a swing motion of the flap 120. In the insertion mode where the flap 120 is located in the upper position, the switching mechanism sets the state between the assist feed roller 300 and the document sheet M to the contact state. In the stacking mode where the flap 120 is located in the lower position, the switching mechanism sets the state between the assist feed roller 300 and the document sheet M to the non-contact state.

Each of the roller guards 430 is formed substantially in an arc shape when viewed in the width direction. The roller guards 430 are disposed at the upstream end of the fixed tray 110 so as to pinch the assist feed roller 300 (see FIG. 1 as well). Each of the roller guards 430 is supported swingably around a swing shaft 431 (a swing center) disposed at an upstream side of the roller guard 430.

Specifically, each of the roller guards 430 is configured to swing between a protruding position and a receding position. In the protruding position, as illustrated in FIG. 3A, each of the roller guards 430 protrudes from the upper surface of the catch tray 100 (the fixed tray 110) higher than the assist feed roller 300. Thereby, the roller guards 430 push up a part of the document sheet M on the catch tray 100, and thus the state between the assist feed roller 300 and the document sheet M is set to the non-contact state. Meanwhile, in the receding position, as illustrated in FIG. 3B, each of the roller guards 430 recedes down from the protruding position. Thereby, the state between the assist feed roller 300 and the document sheet M is set to the contact state.

Each of the roller guards 430 has a contact section 432 that is provided at an upstream end of each roller guard 430 and configured to contact a downstream end 124 of the flap 120. The contact section 432 is pushed by (the downstream end 124 of) the flap 120 and swung from the receding position to the protruding position, in response to the swing motion of the flap 120 from the upper position to the lower position. At this time, the contact section 432 is supported in contact with the downstream end 124 of the flap 120 and held in the protruding position.

In the state where each of the roller guards 430 is held in the protruding position, a distance L1 is longer than a distance L2 (see FIG. 3A). It is noted that as illustrated in FIG. 3A, the distance L1 represents a horizontal component of a distance between the swing shaft 121 (the swing center) of the flap 120 and the protruding section 123 that is an upstream end on which the document sheet M is loaded. Further, the distance L2 represents a horizontal component of a distance between the swing shaft 431 (the swing center) of each roller guard 430 and a load receiving section 433 that receives a load of the document sheet M on the catch tray 100. In addition, a difference between a height (a vertical distance) from a contact portion between the contact section 432 and the downstream end 124 up to the swing shaft 121 and a height from the contact portion up to the swing shaft 431 is smaller than a difference between the distance L1 and the distance L2.

Thereby, when the load of the document sheet M ejected on the catch tray 100 is applied to the load receiving section 433, each roller guard 430 is prevented from being pushed down to the receding position, based on the principle of leverage, since the distance is longer than the distance L2. Consequently, it is possible to avoid contact between the assist feed roller 300 and the document sheet M in the non-contact state.

Meanwhile, as shown in FIG. 3B, when swung from the lower position to the upper position, (the downstream end 124 of) the flap 120 is away from the contact section 432 such that the contact section 432 is released from the state held in the protruding position. At this time, each roller guard 430 swings from the protruding position to the receding position since a downstream side of each roller guard 430 relative to the swing shaft 431 is heavier than an upstream side thereof.

<Operation of Document Feeder>

Next, an explanation will be provided about an operation of the document feeder 1 configured as above in each ejection mode.

[Operation in Stacking Mode]

As shown in FIG. 3A, in the stacking mode where the flap 120 is in the lower position, the document feeder 1 performs document feeding for reading both sides of each document sheet M (M1 and M2). At this time, each roller guard 430 is in the protruding position, the first guide member 61 is set in an upper position, and the second guide member 62 is set in a lower position.

As shown in FIG. 5A, in the stacking mode (the document feeding for reading both sides of each document sheet M), the document sheet M2 (M1) is set on the feed tray 10 with a first read side P3 (P1) thereof facing down and a second read side P4 (P2) thereof facing up.

When the document feeding is started, the document sheet M2 on the feed tray 10 is fed to the feeding path 31 by the separation roller 43. Then, the document sheet M2 is fed to the reading position R by the first feed roller 45 such that the first read side P3 is read by the image sensor 2S. Thereafter, the document sheet M2 is conveyed to the reverse path 32 (the first path 32A) by the second feed rollers 47 and the first guide member 61.

The document sheet M2 fed to the reverse path 32 (the first path 32A) is ejected toward the outside by the third feed rollers 51 and the switchback rollers 53 rotating in the forward direction. At this time, as illustrated in FIG. 4A, the planet gear 324 is away from the transmission gear 325 to be unable to transmit the driving force to the transmission gear. Therefore, the assist feed roller 300 stops.

According to the sheet ejector configured as above, even though the document sheet M1 that has already been ejected on the catch tray 100 is partially inserted between the roller guards 430 set in the protruding position and contacts the assist feed roller 300 as the document sheet M1 is folded or curled, it is possible to prevent the document sheet M1 from being fed and falling out of the catch tray 100.

When the document sheet M2 is almost completely fed ahead of the switchback rollers 53, the switchback rollers 53 are temporarily stopped by a known control technique. At this time, the first guide member 61 is swung to the lower position, and the second guide member 62 is swung to the upper position. Further, the document sheet M2 is set with the first read side P3 facing up and the second read side P4 facing down.

After that, as shown in FIG. 3B, the switchback rollers 53 are rotated in the backward direction, and the document sheet M2 is pulled back to the reverse path 32 (the first path 32A) and fed to the second path 32B. Then, the document sheet M2 is conveyed from the second path 32B to the feeding path 31. Thereafter, the document sheet M2 is fed to the reading position R by the first feed rollers 45, and the second read side P4 is read by the image sensor 2S.

The document sheet M2, of which the second read side P4 has been read, is ejected onto the catch tray 100 by the ejection rollers 200. In the stacking mode, the protruding section 123 of the flap 120 is located lower than a nipping position of the ejection rollers 200. Therefore, the document sheet M2 is ejected so as to be stacked on the document sheet M1 that has already been ejected on the catch tray 100.

At this time, the roller guards 430 are in the protruding position, and therefore the state between the assist feed roller 300 and the document sheets M (M1 and M2) on the catch tray 100 is set in the non-contact state. Thereby, even though the assist feed roller 300 is driven to rotate (see FIG. 4B), the document sheets M can be prevented from being fed and thus from falling out of the catch tray 100.

It is noted that the document sheet M2 is ejected onto the document sheet M1, with the first read side P3 facing down and the second read side P4 facing up. In the same manner, the document sheet M1 has been ejected with the first read side P1 facing down and the second read side P2 facing up. Hence, in the stacking mode, the document sheets M1 and M2 are stacked on the catch tray 100 with pages thereof arranged in the following order from the bottom, P1, P2, P3, and P4. The above order of the pages is the same as that for the document sheets M1 and M2 placed on the feed tray 10.

[Operation in Insertion Mode]

As shown in FIG. 3B, in the insertion mode where the flap 120 is in the upper position, the document feeder 1 performs document feeding for reading a single side of each document sheet M (M1 and M2). At this time, each roller guard 430 is in the receding position, and the first guide member 61 is set in a lower position. It is noted that in the stacking mode (at least during the document feeding), as illustrated in FIG. 4B, since the motor 310 is controlled to rotate in the aforementioned predetermined direction, the planet gear 324 is engaged with the transmission gear 325 to transmit the driving force to the transmission gear 325, and the assist feed roller 300 is driven to rotate.

As shown in FIG. 6, in the stacking mode (the document feeding for reading a single side of each document sheet M), the document sheet M2 (M1) is set on the feed tray 10 with a read side P2 (P1) facing down.

When the document feeding is started, the document sheet M2 on the feed tray 10 is fed to the feeding path 31 by the separation roller 43. Then, the document sheet M2 is fed to the reading position R by the first feed roller 45 such that the read side P2 is read by the image sensor 2S.

The document sheet M2, of which the read side P2 has been read, is ejected onto the catch tray 100 by the ejection rollers 200. In the insertion mode, the protruding section 123 of the flap 120 (a rear end of the document sheet M1) is located higher than the nipping position of the ejection rollers 200. Therefore, the document sheet M2 is ejected so as to be inserted under the document sheet M1 that has already been ejected on the catch tray 100.

At this time, the roller guards 430 are in the receding position, and therefore the state between the assist feed roller 300 and the document sheets M (M1 and M2) on the catch tray 100 is set in the contact state. Thereby, the ejected document sheet M2 is fed by the assist feed roller 300 in an auxiliary manner, and inserted under the earlier-ejected document sheet M1 in a preferable manner.

In the embodiment, the flap 120 is configured to extend in the horizontal direction. Additionally, the fixed tray 110 is configured to extend obliquely upward. Further, the assist feed roller 300 is disposed at the upstream end of the fixed tray 110. Therefore, a leading end of the ejected document sheet M2 moves toward the assist feed roller 300. Thereby, it is possible to certainly establish contact between the document sheet M2 and the assist feed roller 300 and thus to certainly obtain the operation of the assist feed roller 300.

Further, the document sheet M2 is ejected under the document sheet M1, with the read side P2 facing up. In the same manner, the document sheet M1 is ejected with the read side P1 facing up. Therefore, in the insertion mode, the document sheets M1 and M2 are stacked with pages thereof arranged in the following order from the top, P1 and P2. The above order of the pages is the same as that for the document sheets M1 and M2 placed on the feed tray 10.

As described above, according to the document feeder 1 having the sheet ejector of the embodiment, it is possible to assist the later-ejected document sheet M2 to insert under the earlier-ejected document sheet M1 in a preferable manner, by employing the assist feed roller 300. Further, it is possible to switch the state of the assist feed roller 300 relative to the sheet on the catch tray 100 between the contact state and the non-contact state, by employing the switching mechanism (the flap 120, the cam 410, and the roller guards 430). Thus, it is possible to insert the later-ejected document sheet M2 under the earlier-ejected document sheet M1 in a preferable manner, by making the assist feed roller 300 function depending on whether the ejection mode is set in the insertion mode.

In the embodiment, the switching mechanism includes the roller guards 430, which is configured to switch the state of the assist feed roller 300 relative to the sheet on the catch tray 100 between the contact state and the non-contact state, by swinging between the protruding position and the receding position. Therefore, it is possible to fix the position of the assist feed roller 300. Thereby, it is possible to make a configuration of a driving mechanism for the assist feed roller 300 simpler than that for a movable assist feed roller 300.

In particular, in the embodiment, the switching mechanism (the roller guards 430) is configured to operate in conjunction with the swing motion of the flap 120 and swing between the protruding position and the receding position, so as to switching the state between the assist feed roller 300 and a sheet on the catch tray 100 between the contact state and the non-contact state. Hence, it is not required to separately provide a mechanism for swinging the roller guards 430. Thereby, it is possible to simplify the configuration of the document feeder 1 and save a manufacturing cost of the document feeder 1.

In the embodiment, the document feeder 1 is configured to provide the driving force of the single motor 310 to the assist feed roller 300 and the switchback rollers 53, and to drive or stop the assist feed roller 300 depending on the rotational direction of the motor 310. Therefore, it is possible to make the assist feed roller 300 function as needed. Further, it is possible to reduce the manufacturing cost and the size of the document feeder 1, since it is not required to separately provide a motor for driving the assist feed roller 300.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the aforementioned embodiment, the catch tray 100 includes the single assist feed roller 300 (see FIG. 1). However, the catch tray 100 may include a plurality of assist feed rollers disposed in any of the width direction and the ejecting direction.

In the aforementioned embodiment, each roller guard 430 is configured to swing between the protruding position and the receding position. However, for instance, each roller guard 430 may be configured to move linearly up and down between a protruding position and a receding position.

In the aforementioned embodiment, each roller guard 430 is configured to, in response to the flap 120 swinging down, be pushed by the flap 120 and swung from the receding position to the protruding position. Further, each roller guard 430 is configured to, in response to the flap 120 swinging up, swing from the protruding position to the receding position owing to the weight of the downstream side of each roll guard 430 relative to the swing shaft 431 that is heavier than the upstream side.

However, for instance, a spring may be provided that is configured to always urge each roller guard 430 toward the protruding position. Namely, each roller guard 430 may be configured to, in response to the flap 120 swinging up, be pushed by the flap 120 and swung from the protruding position to the receding position. Further, each roller guard 430 may be configured to, in response to the flap 120 swinging down, be swung by an urging force of the spring from the receding position to the protruding position. Further, each roller guard 430 may be disposed to always contact the flap 120. In this case, each roller guard 430 may be configured to, in response to the flap 120 swinging up and down, be pushed by the flap 120 and swung between the protruding position and the receding position, owing to a change in a contact state (e.g., a contact area and a contact position) between the flap 120 and each roller guard 430.

In the aforementioned embodiment, in order to certainly establish contact between the later-ejected document sheet and the assist feed roller 300, the flap 120 is disposed to extend in the horizontal direction in the insertion mode, the fixed tray 110 is disposed to extend obliquely upward in the insertion mode, and the assist feed roller 300 is disposed at the upstream end of the fixed tray 110. However, for instance, a flap may be disposed to extend obliquely upward toward a downstream side in the insertion mode, a fixed tray may be disposed to extend obliquely upward at a greater angle in the insertion mode, and an assist feed roller may be disposed at an upstream end of the fixed tray.

In the aforementioned embodiment, the switching mechanism (the flap 120, the cam 410, and the roller guards 430) is configured to, depending on whether the ejection mode is set in the insertion mode or the stacking mode, switch the state of the assist feed roller 300 relative to the document sheet on the catch tray 100 between the contact state and the non-contact state. However, for instance, the switching mechanism may be configured to, depending on a sheet type or the number of sheets ejected on the catch tray 100, switch the state of the assist feed roller 300 relative to the document sheet on the catch tray 100 between the contact state and the non-contact state. Specifically, the switching mechanism may switch the state of the assist feed roller 300 relative to the document sheet on the catch tray 100 between the contact state and the non-contact state, when a user selects a predetermined type of sheet (e.g., a heavy type of sheet), or when the number of sheets ejected on the catch tray 100 exceeds a predetermined number.

In the aforementioned embodiment, in order to switch the ejection mode, the flap 120 is provided that switches the ejection mode between the insertion mode and the stacking mode along with a swing motion of the upstream end 122 of the flap 120 in the vertical direction. However, for instance, a flap may be employed that switches the ejection mode along with a vertical slide motion of the flap. Furthermore, a catch tray may be employed of which the position is fixed. In this case, ejection rollers may be provided that moves up and down to switch the ejection mode.

In the aforementioned embodiment, some aspects of the present invention are applied to the document feeder 1 configured to switch the ejection mode. However, aspects of the present invention may be applied to a sheet feeder or a sheet ejector configured to eject sheets only in the insertion mode.

In the aforementioned embodiment, the switching mechanism includes the cam 410, the flap 120, and the roller guards 430. However, for instance, the switching mechanism may include roller guards or an alternative switching member that is manually moved between the protruding position and the receding position. Further, an assist feed roller may be employed that is configured to move between a contact position where the assist feed roller contacts the sheet on the catch tray 100 and a non-contact position where the assist feed roller does not contact the sheet on the catch tray 100.

In the aforementioned embodiment, some aspects of the present invention are applied to the document feeder 1 configured with the catch tray 100 disposed above the feed tray 10. However, aspects of the present invention may be applied to a document feeder configured with a catch tray disposed under a feed tray. Further, aspects of the present invention may be applied to a sheet ejector of an image forming device such as a printer and a copy machine.

In the aforementioned embodiment, the switchback rollers 53 are exemplified as reverse rollers. However, ejection rollers for a document feeder or an image forming device may be employed as reverse rollers.

In the aforementioned embodiment, a document sheet with an image formed on each side or a single side thereof is exemplified as a sheet to be ejected. However, for instance, when aspects of the present invention are applied to an image forming device, a blank sheet or a transparent sheet (for an overhead projector) may be employed as a sheet to be ejected.

In the aforementioned embodiment, the assist feed roller 300 is configured to be driven to rotate when the motor 310 rotates in one direction and causes the switchback rollers 53 to rotate in such a direction as to pull back a document sheet. Further, the assist feed roller 300 is configured to be stopped when the motor 310 rotates in the other direction and causes the switchback rollers 53 to rotate in such a direction as to eject a document sheet.

However, for instance, when aspects of the present invention are applied to a printer configured to form an image on each side of a sheet, the assist feed roller 300 may be configured to be driven to rotate when a driving source rotates in one direction and causes ejection rollers (reverse rollers) to rotate in such a direction as to eject a sheet. Further, the assist feed roller 300 may be configured to be stopped when the driving source rotates in the other direction and causes the ejection rollers to rotate in such a direction as to pull back a sheet.

What is claimed is:

1. A sheet ejector comprising:

a feed roller having a portion disposed lower than a catch tray and located on a sheet entry end of a fixed tray of the catch tray, wherein the feed roller is adapted to feed, in a predetermined ejecting direction, a later-ejected sheet under an earlier-ejected sheet; and a switching mechanism, different from the feed roller and the catch tray, adapted to switch a state of the feed roller relative to a sheet on the catch tray between:

a contact state where the feed roller contacts the sheet when the sheet is on the catch tray at in a first position along a sheet feed path; and a non-contact state where the feed roller is kept from contacting the sheet when the sheet is on the catch tray in the same first position along the sheet feed path, wherein the switching mechanism includes a flap forming a portion of the catch tray and positioned upstream from the fixed tray and the feed roller in the predetermined ejecting direction, wherein the flap is adapted to, in response to an upstream end thereof in the predetermined ejecting direction swinging up and down, switch an ejection mode between:

an insertion mode to insert a later-ejected sheet under an earlier-ejected sheet on the catch tray; and a stacking mode to stack a later-ejected sheet on an earlier-ejected sheet on the catch tray, and wherein the switching mechanism is adapted to, in response to the upstream end of the flap swinging up and down, switch the state of the feed roller relative to the sheet on the catch tray to the contact state in the insertion mode and to the non-contact state in the stacking mode.

2. The sheet ejector according to claim 1, wherein the feed roller is disposed such that at least another portion thereof protrudes higher than the catch tray, and wherein the switching mechanism comprises a switching member adapted to move between:

a protruding position where the switching member protrudes up from the catch tray higher than the feed roller and pushes up the sheet on the catch tray so as to set the state of the feed roller relative to the sheet on the catch tray to the non-contact state; and a receding position where the switching member recedes down from the protruding position so as to set the state of the feed roller relative to the sheet on the catch tray to the contact state.

3. The sheet ejector according to claim 1, wherein the catch tray comprises the flap and a fixed tray disposed at a downstream side relative to the flap in the predetermined ejecting direction, and wherein the flap is adapted to, in the insertion mode, extend in one of a horizontal direction and a direction that is obliquely upward toward a downstream side in the predetermined ejecting direction.

4. The sheet ejector according to claim 1, wherein the feed roller is disposed such that at least another portion thereof protrudes higher than the catch tray, and wherein the switching mechanism comprises a switching member adapted to, in response to the upstream end of the flap swinging up and down, move between:

a protruding position where the switching member protrudes up from the catch tray higher than the feed roller and pushes up the sheet on the catch tray so as to set the state of the feed roller relative to the sheet on the catch tray to the non-contact state; and a receding position where the switching member recedes down from the protruding position so as to set the state of the feed roller relative to the sheet on the catch tray to the contact state.

5. The sheet ejector according to claim 1, further comprising an ejection roller adapted to rotate at a first circumferential velocity and eject a sheet onto the catch tray, wherein the feed roller is adapted to rotate at a second circumferential velocity lower than the first circumferential velocity of the ejection roller.

6. The sheet ejector according to claim 1, further comprising:

a reverse roller adapted to rotate in any of a direction for ejecting a sheet and a direction for pulling back the sheet so as to reverse the sheet upside down;

a driving source adapted to rotate in any of a first direction and a second direction opposite to the first direction so as to generate a driving force; and a gear unit comprising:

a first gear adapted to transmit the driving force from the driving source to the reverse roller;

a second gear adapted to transmit the driving force to the feed roller; and a third gear adapted to, when the driving source rotates in the first direction, engage with a transmission gear so as to transmit the driving force to the transmission gear, wherein the third gear is further adapted to, when the driving source rotates in the second direction, get away from the transmission gear.

7. A sheet feeder comprising:

a feed roller having a portion disposed under a catch tray and located on a sheet entry end of a fixed tray of the catch tray, wherein the feed roller is adapted to feed, in a predetermined ejecting direction, a later-ejected sheet under an earlier-ejected sheet; and a switching mechanism, different from the feed roller and the catch tray, adapted to switch a state of the feed roller relative to a sheet on the catch tray between:

a contact state where the feed roller contacts the sheet when the sheet is on the catch tray in a first position along a sheet feed path; and a non-contact state where the feed roller is kept from contacting the sheet when the sheet is on the catch tray in the same first position along the sheet feed path, wherein the switching mechanism includes a flap forming a portion of the catch tray and positioned upstream from the fixed tray and the feed roller in the predetermined ejecting direction, wherein the flap is adapted to, in response to an upstream end thereof in the predetermined ejecting direction swinging up and down, switch an ejection mode between:

an insertion mode to insert a later-ejected sheet under an earlier-ejected sheet on the catch tray; and a stacking mode to stack a later-ejected sheet on an earlier-ejected sheet on the catch tray, and wherein the switching mechanism is adapted to, in response to the upstream end of the flap swinging up and down, switch the state of the feed roller relative to the sheet on the catch tray to the contact state in the insertion mode and to the non-contact state in the stacking mode.

8. The sheet feeder according to claim 7, wherein the feed roller is disposed such that at least another portion thereof protrudes up from the catch tray, and wherein the switching mechanism comprises a switching member adapted to move between:

a protruding position where the switching member protrudes up from the catch tray higher than the feed roller and pushes up the sheet on the catch tray so as to set the state of the feed roller relative to the sheet on the catch tray to the non-contact state; and a receding position where the switching member recedes down from the protruding position so as to set the state of the feed roller relative to the sheet on the catch tray to the contact state.

9. The sheet feeder according to claim 7, wherein the feed roller is disposed such that at least another portion thereof protrudes up from the catch tray, and wherein the switching mechanism comprises a switching member adapted to, in response to the upstream end of the flap swinging up and down, move between:

a protruding position where the switching member protrudes up from the catch tray higher than the feed roller and pushes up the sheet on the catch tray so as to set the state of the feed roller relative to the sheet on the catch tray to the non-contact state; and a receding position where the switching member recedes down from the protruding position so as to set the state of the feed roller relative to the sheet on the catch tray to the contact state.

10. The sheet feeder according to claim 7, wherein the catch tray comprises the flap and a fixed tray disposed at a downstream side relative to the flap in the predetermined ejecting direction, and wherein the flap is adapted to, in the insertion mode, extend in one of a horizontal direction and a direction that is obliquely upward toward a downstream side in the predetermined ejecting direction.

11. The sheet feeder according to claim 7, further comprising an ejection roller adapted to rotate at a first circumferential velocity and eject a sheet onto the catch tray, wherein the feed roller is adapted to rotate at a second circumferential velocity lower than the first circumferential velocity of the ejection roller.

12. The sheet feeder according to claim 7, further comprising:

a reverse roller adapted to rotate in any of a direction for ejecting a sheet and a direction for pulling back the sheet so as to reverse the sheet upside down;

a driving source adapted to rotate in any of a first direction and a second direction opposite to the first direction so as to generate a driving force; and a gear unit comprising:

a first gear adapted to transmit the driving force from the driving source to the reverse roller;

a second gear adapted to transmit the driving force to the feed roller; and a third gear adapted to, when the driving source rotates in the first direction, engage with a transmission gear so as to transmit the driving force to the transmission gear, wherein the third gear is further adapted to, when the driving source rotates in the second direction, get away from the transmission gear.

13. A sheet ejector adapted to eject sheets so as to insert a later-ejected sheet under an earlier-ejected sheet on a catch tray, comprising:

a flap provided to the catch tray and adapted to, in response to an upstream end thereof in the predetermined ejecting direction swinging up and down, switch an ejection mode between:

an insertion mode to insert the later-ejected sheet under the earlier-ejected sheet on the catch tray, and a stacking mode to stack the later-ejected sheet on the earlier-ejected sheet on the catch tray;

a feed roller having a first portion disposed lower than the catch tray and a second portion protruding higher than the catch tray, wherein the feed roller is adapted to feed, in a predetermined ejecting direction, the later-ejected sheet that is inserted under the earlier-ejected sheet; and a switching mechanism adapted to switch a state of the feed roller relative to a sheet on the catch tray between:

a contact state where the feed roller contacts the sheet on the catch tray; and a non-contact state where the feed roller is kept from contacting the sheet on the catch tray, wherein the switching mechanism is further adapted to, in response to the upstream end of the flap swinging up and down, switch the state of the feed roller relative to the sheet on the catch tray to the contact state in the insertion mode and to the non-contact state in the stacking mode, wherein the switching mechanism comprises a switching member adapted to, in response to the upstream end of the flap swinging up and down, move between:

a protruding position where the switching member protrudes up from the catch tray higher than the feed roller and pushes the sheet on the catch tray upward so as to set the state of the feed roller relative to the sheet on the catch tray to the non-contact state; and a receding position where the switching member recedes down from the protruding position so as to set the state of the feed roller relative to the sheet on the catch tray to the contact state, wherein when the upstream end of the flap swings down, the switching member is pushed by the flap to move to the protruding position, and wherein when the upstream end of the flap swings up, the switching member is away from the flap and moves to the receding position.

14. The sheet ejector according to claim 13, wherein when the upstream end of the flap swings up, the switching member is away from the flap, and moves to the receding position due to a weight of the switching member.

15. The sheet ejector according to claim 13, wherein the switching member comprises a contact section adapted to contact the flap, and wherein when the upstream end of the flap swings down, the switching member is moved to the protruding position with the contact section thereof being pushed by the flap.

16. A sheet feeder comprising:

a flap provided to the catch tray and adapted to, in response to an upstream end thereof in the predetermined ejecting direction swinging up and down, switch an ejection mode between:

an insertion mode to insert a later-ejected sheet under an earlier-ejected sheet on a catch tray, and a stacking mode to stack the later-ejected sheet on the earlier-ejected sheet on the catch tray;

a feed roller having a first portion disposed lower than the catch tray and a second portion protruding higher than the catch tray, wherein the feed roller is adapted to feed, in a predetermined ejecting direction, the later-ejected sheet that is inserted under the earlier-ejected sheet; and a switching mechanism adapted to switch a state of the feed roller relative to a sheet on the catch tray between:

a contact state where the feed roller contacts the sheet on the catch tray; and a non-contact state where the feed roller is kept from contacting the sheet on the catch tray, wherein the switching mechanism is further adapted to, in response to the upstream end of the flap swinging up and down, switch the state of the feed roller relative to the sheet on the catch tray to the contact state in the insertion mode and to the non-contact state in the stacking mode, wherein the switching mechanism comprises a switching member adapted to, in response to the upstream end of the flap swinging up and down, move between:

a protruding position where the switching member protrudes up from the catch tray higher than the feed roller and pushes up the sheet on the catch tray so as to set the state of the feed roller relative to the sheet on the catch tray to the non-contact state; and a receding position where the switching member recedes down from the protruding position so as to set the state of the feed roller relative to the sheet on the catch tray to the contact state, wherein when the upstream end of the flap swings down, the switching member is pushed by the flap to move to the protruding position, and wherein when the upstream end of the flap swings up, the switching member is away from the flap and moves to the receding position.

17. A sheet feeder comprising:

a flap provided to a catch tray and adapted to, in response to an upstream end thereof in the predetermined ejecting direction swinging up and down, switch an ejection mode between:

an insertion mode to insert a later-ejected sheet under an earlier-ejected sheet on the catch tray, and a stacking mode to stack the later-ejected sheet on the earlier-ejected sheet on the catch tray;

a feed roller having a first portion disposed lower than the catch tray and a second portion protruding higher than the catch tray, wherein the feed roller is adapted to feed, in a predetermined ejecting direction, the later-ejected sheet that is inserted under the earlier-ejected sheet; and a switching mechanism adapted to switch a state of the feed roller relative to a sheet on the catch tray between:

a contact state where the feed roller contacts the sheet on the catch tray; and a non-contact state where the feed roller is kept from contacting the sheet on the catch tray, wherein the switching mechanism is further adapted to, in response to the upstream end of the flap swinging up and down, switch the state of the feed roller relative to the sheet on the catch tray to the contact state in the insertion mode and to the non-contact state in the stacking mode, wherein the switching mechanism comprises a switching member adapted to, in response to the upstream end of the flap swinging up and down, move between:

a protruding position where the switching member protrudes up from the catch tray higher than the feed roller and pushes up the sheet on the catch tray so as to set the state of the feed roller relative to the sheet on the catch tray to the non-contact state; and a receding position where the switching member recedes down from the protruding position so as to set the state of the feed roller relative to the sheet on the catch tray to the contact state, wherein the flap is adapted to swing around a swing axis of the flap, the swing axis of the flap being disposed at a downstream side of the flap in the predetermined ejecting direction, wherein the switching member is adapted to swing around a swing axis of the switching member, the swing axis of the switching member being disposed at an upstream side of the switching member in the predetermined ejecting direction, wherein a first distance is a horizontal component of a distance between the swing axis of the flap and an upstream end portion of the flap in the predetermined ejecting direction, on which a sheet is loaded, wherein a second distance is a horizontal component of a distance between the swing axis of the switching member and a portion of the switching member which portion contacts and pushes up the sheet on the catch tray in the protruding position, and wherein the first distance is longer than the second distance.

18. A sheet ejector adapted to eject sheets so as to insert a later-ejected sheet under an earlier-ejected sheet on a catch tray, comprising:

a flap provided to the catch tray and adapted to, in response to an upstream end thereof in the predetermined ejecting direction swinging up and down, switch an ejection mode between:

an insertion mode to insert the later-ejected sheet under the earlier-ejected sheet on the catch tray, and a stacking mode to stack the later-ejected sheet on the earlier-ejected sheet on the catch tray;

a feed roller having a first portion disposed lower than the catch tray and a second portion protruding higher than the catch tray, wherein the feed roller is adapted to feed, in a predetermined ejecting direction, the later-ejected sheet that is inserted under the earlier-ejected sheet; and a switching mechanism adapted to switch a state of the feed roller relative to a sheet on the catch tray between:

a contact state where the feed roller contacts the sheet on the catch tray; and a non-contact state where the feed roller is kept from contacting the sheet on the catch tray, wherein the switching mechanism is further adapted to, in response to the upstream end of the flap swinging up and down, switch the state of the feed roller relative to the sheet on the catch tray to the contact state in the insertion mode and to the non-contact state in the stacking mode, wherein the switching mechanism comprises a switching member adapted to, in response to the upstream end of the flap swinging up and down, move between:

a protruding position where the switching member protrudes up from the catch tray higher than the feed roller and pushes the sheet on the catch tray upward so as to set the state of the feed roller relative to the sheet on the catch tray to the non-contact state; and a receding position where the switching member recedes down from the protruding position so as to set the state of the feed roller relative to the sheet on the catch tray to the contact state, wherein the flap is further adapted to swing around a swing axis of the flap, the swing axis of the flap being disposed at a downstream side of the flap in the predetermined ejecting direction, wherein the switching member is further adapted to swing around a swing axis of the switching member, the swing axis of the switching member being disposed at an upstream side of the switching member in the predetermined ejecting direction, wherein a first distance is a horizontal component of a distance between the swing axis of the flap and an upstream end portion of the flap in the predetermined ejecting direction, on which a sheet is loaded, wherein a second distance is a horizontal component of a distance between the swing axis of the switching member and a portion of the switching member which portion contacts and pushes up the sheet on the catch tray in the protruding position, and wherein the first distance is longer than the second distance.

* * * * *